US005747106A

United States Patent [19]

Matsunaga

[11] Patent Number: 5,747,106

[45] Date of Patent: May 5, 1998

[54] TWO STAGE POWDER APPLICATION METHOD

[75] Inventor: Masafumi Matsunaga, Tokyo, Japan

[73] Assignee: Nordson Corporation, Westlake, Ohio

[21] Appl. No.: 513,893

[22] PCT Filed: Mar. 14, 1994

[86] PCT No.: PCT/US94/02743

§ 371 Date: Feb. 26, 1996

§ 102(e) Date: Feb. 26, 1996

[87] PCT Pub. No.: WO94/21385

PCT Pub. Date: Sep. 29, 1994

[30] Foreign Application Priority Data

Mar. 15, 1993 [JP] Japan ..... 5-081440

[51] Int. Cl.[6] ..... B05D 1/02

[52] U.S. Cl. ..... 427/201; 427/202; 427/203; 427/421

[58] Field of Search ..... 427/202, 201, 427/203, 195, 470, 204, 258, 379, 136, 137, 162, 168, 421

[56] References Cited

U.S. PATENT DOCUMENTS

| | | | |
|---|---|---|---|
| 3,348,995 | 10/1967 | Baker et al. . | |
| 4,542,539 | 9/1985 | Rowe et al. | 623/16 |

FOREIGN PATENT DOCUMENTS

| | | |
|---|---|---|
| 0523761A2 | 3/1988 | European Pat. Off. . |
| 523761 | 1/1993 | European Pat. Off. . |
| 2-18861 | 1/1990 | Japan . |

*Primary Examiner*—Shrive Beck
*Assistant Examiner*—Fred J. Parker
*Attorney, Agent, or Firm*—Wood, Herron & Evans, L.L.P.

[57] ABSTRACT

A two stage powder coating method involves applying relatively large size powder particles to a surface to be coated during a first coating stage, followed by applying relatively small size powder particles to the large size particles during a second coating stage. The particles may be heated to cause melting after the first and/or the second stages, thereby to level the coating. This two stage powder application method assures a level, uniform and aesthetically pleasing finish for the applied powder coating, even for surfaces with hollow and/or recessed portions.

6 Claims, 1 Drawing Sheet

TWO STAGE POWDER APPLICATION METHOD

FIELD OF THE INVENTION

This invention relates to an improved method for powder coating.

BACKGROUND OF THE INVENTION

In many powder coating applications, the average particle diameter applied to the surface to be coated varies depending on the thickness of the coating. For instance, if a relatively thick coating is desired, particles having a thick diameter are used. If a relatively thin coating is desired, particles having a thin diameter are used.

However, with large sized particles, the applied coating or film does not always appear level and smooth, even if heating is used to coalesce the particles after contact on the surface. This poor leveling of large particles is particularly acute when the coating material is a thermosetting polymer. In some cases, the coating looks uneven, like the external surface of a lemon, an effect sometimes referred to in the industry as the "orange peel" phenomenon.

In contradistinction, leveling is more easily achieved with smaller sized particles. However, per particle, the ratio of surface area to weight becomes high, and bulk density drops. When the particles are applied by spraying, the effect of air resistance makes it difficult to maintain a straight flight path for long distances. The ability to maintain a straight flight path is referred to as linearity. For coating objects with hollow or recessed portions, penetration of the small powder particles to these surfaces is poor. This poor coverage necessitates an increase in powder ejection air pressure. However, this increased ejection air pressure results in increased flow volume, so that while this additional air pressure carries the particles farther it tends also to carry particles away from the surface when the transport air rebounds away from the surface.

Additionally, powder having a relatively small or fine particle size has a high manufacturing cost. Thus, despite its well known coating qualities, the industry has generally not used powders of relatively small size particles.

It is an objective of this invention to improve the leveling and the aesthetic appearance of a powder coating applied to a surface, without compromising the delivery of the powder particles to the surface being coated or the adhesion of particles to the surface.

SUMMARY OF THE INVENTION

The present invention achieves the above-stated objectives by a two step particle application method which involves initially applying large size particles to a coating surface, followed by applying small particles to the large size particles. The average particle diameter for the powder applied during the first stage (Stage A) is 15 to 120 microns, and the average particle diameter for the powder applied during the second stage (Stage B) is 0.1 to 15 microns.

Preferably during both stages, the particles are applied by spraying. The larger sized particles applied during the first stage may be temporarily heated to cause partial melting and increased adherence. Subsequently, when the second stage particles are applied, heat may again be used to melt the applied powder particles. Stages A and B may be repeated as necessary, to achieve the desired coating thickness.

One advantage that results from this two stage powder application method is increased adhesion efficiency. Also, by initially applying the larger sized particles, the desired film thickness can be achieved, while subsequent application of the smaller sized particles improves overall leveling and surface appearance.

These and other features of the invention will be more readily understood in view of the following detailed description and the drawings.

DETAILED DESCRIPTION OF THE PREFERRED EMBODIMENTS

Figure 1:
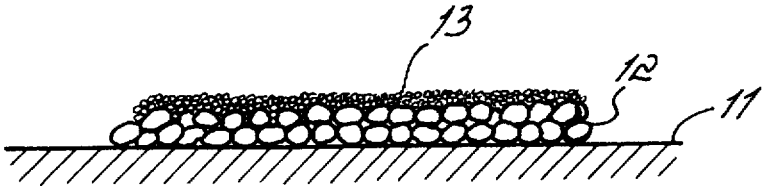
FIG. 1 is a cross-sectional view which schematically shows a powder coating achieved with the two stage powder application method of this invention, wherein the coated surface is flat.

FIG. 1 depicts a surface 11 to be coated, and in this case the surface 11 is flat. The two stage powder application method of this invention involves initially applying to the surface 11 a powder 12 having a relatively large particle diameter. Preferably, the powder 12 has an average particle diameter in the range of about 15 to 120 microns. Subsequently, a powder 13 having a relatively small particle diameter is applied. Preferably, the powder 13 has an average particle diameter in the range of about 0.1 to 15 microns. Thus, the large particles 12 are applied during a first stage, while the smaller particles 13 are applied during a second stage. Preferably, the powder applied during the first and second stages are applied by spraying.

Because of the large particle diameter used in the first stage, the desired film thickness can be achieved. Subsequent application of the small particles 13 improves overall leveling and surface finish of the coating on the surface 11.

Figure 2:
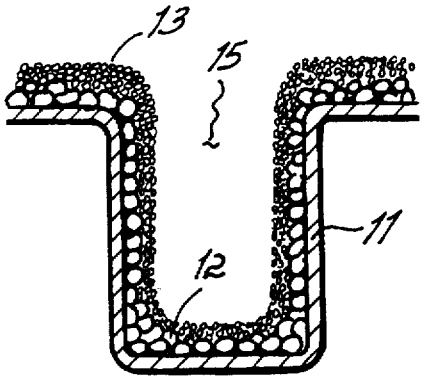
FIG. 2 is a cross-sectional view, similar to FIG. 1, which schematically shows a powder coating achieved with the two stage powder coating method of this invention, wherein the coated surface has a recess.

FIG. 2 illustrates another advantage of this two stage powder application method, an advantage which relates particularly to coating objects or articles which have an external surface with one or more hollow or recessed narrow portions, such as steel tools. Coating of objects such as this increases their resistance to rust. These objects usually also have one or more external surface sites which are more noticeable to consumers and thereby must have a favorable aesthetic appearance. A favorable appearance of this type generally requires coating with relatively small diameter particles. The two stage powder application method of this invention achieves both of these objectives, uniform coating of recessed narrow portions and an aesthetically pleasing coating on the external surface sites which are most noticeable to the consumer.

More particularly, FIG. 2 illustrates a portion of the surface 11 which has a recess 15 formed therein. Again, the coating on the surface 11 comprises an initial application of relatively large particles 12 followed by an application of small particles 13. The relatively large particles 12 used in the first stage of this method assure uniform coating within the recess 15, since the larger particles can penetrate into the recess to be deposited thereon, while the relatively small particles 13 level the overall coating of the entire surface 11 and further assure an aesthetically pleasing coating at the most noticeable sites.

One advantage of this method of powder coating is that in some applications where the coated object is subsequently processed, as in the bending of steel plates, cracks may occur in the coated film during this subsequent processing. However, with the two layers of coating applied according to this method, the bottom layer of large particles is relatively thick and has good workability and adhesive properties, while the top layer of small particles is formed of powder made of materials which are tough and have desired properties, such as chemical and/or weather resistance.

Another advantage of this invention relates to achieving a matted tone, a suede tone or a hammer tone coating for an article. These are design properties which have recently become popular in the market. By using, during the second stage, particles composed of urethane, polystyrene or glass beads which may be colored, it is easy to achieve a film with a matted or suede tone. Also, by using second stage particles which have a resin with poor compatibility with respect to the bottom layer, a hammer tone film can be achieved.

Figure 3:
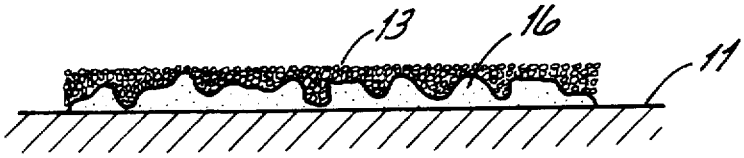
FIG. 3 is a cross-sectional view, similar to FIGS. 1 and 2 wherein the powder particles applied during the first stage are heated to achieve melting on the surface before the second stage of finer particles is applied.

In the application of large particle diameter powders, and particularly those with a high molecular weight, it is difficult to achieve good levelling during heating and melting as noted above. The air present in the interstices between particles impairs levelling, and if the coated surface is too rapidly melted, the air surrounding the particles produces air bubbles. To solve these problems, this two stage powder application method involves temporarily heating the large size particles to melt them and subsequently applying the small size particles to cover the voids or pinholes in areas where the coating is thin or packed by air bubbles. This makes it possible to obtain a high quality film with no pinholes or voids and to achieve favorable levelling. The appearance of such a film is shown in FIG. 3, where reference numeral 16 designates the initially applied large particle diameter powder which is in a molten state due to temporary heating.

The invention contemplates the use of various types of powder. It is preferable to use an organic powder during the first stage, due to better adhesive properties. However, a mixture of inorganic and organic powders or a powder in which an organic powder is surrounded by organic capsules may also be used. This invention results in a high performance powder coating with relatively low costs, particularly when using powders such as fluorine and polyamide which are relatively expensive. Additionally, with a powder made of thermosetting material, due to differences in the catalyst, the hardener or the functional group used, compatibility may be poor and/or a phenomenon referred to as "crawling" may occur. Therefore, it is preferable to use powders composed of the same resin during Stage A and Stage B.

During powder coating, the phenomenon of levelling depends to a large extent on the surface tension during the melting of the powder materials. It has been found that a surface tension of 40 dyne/cm is preferred during melting of the powder. To maximize cost savings and productivity, it is desirable to use relatively large amounts of the large particle diameter powder and to increase the amount used during Stage A of particle application, since this powder is relatively inexpensive compared to the fine powder.

Also, by applying successive layers of powder having a large particle diameter and composed of a resin having a functional group and a small particle diameter powder composed of a hardener, the overall performance of the applied film can be improved. For example, this can be achieved by repeated application in overlapping layers or dispersion application of large diameter particles comprising a mixture of polyester and an isocyanate functional group and small diameter particles in which block isocyanate is encapsulated, followed by heating and melting or cross linking.

For each of these variations of the invention, this two stage powder application method produces a film or coating with favorable levelling, excellent aesthetic appearance, good linearity of the powder during application, good adhesion efficiency and high product quality.

While several preferred embodiments of the invention have been shown and described, it is to be understood that variations in these modifications may be made without departing from the scope of the invention. Accordingly, applicant wishes only to be bound by the claims appended hereto.

We claim:

1. A method for powder coating a surface comprising the steps of:

a) applying to the surface, during a first coating stage, a first layer of powder particles having a first average diameter; and b) applying to the first layer of powder particles, in a second coating stage subsequent to the first coating stage, a second layer of powder particles having a second average diameter smaller than the first average diameter so that at least some of the particles applied during the second coating stage fill spaces between particles applied during the first coating stage, thereby to form a coating on the surface comprising powder particles applied during the first and second stages.

2. The method of claim 1 wherein the first average diameter is in the range of about 15 to 120 microns and the second average diameter is in the range of about 0.1 and 15 microns.

3. The method of claim 1 and further comprising the steps of:

prior to the second coating stage, heating the powder particles applied during the first coating stage to cause melting thereof, and subsequent to the second coating stage, heating all of the powder particles to cause the particles applied during the first and second stages to melt and subsequently harden to form a coating.

4. The method of claim 1 wherein the powder particles used in the first and second coating stages, comprise the same resin as a main component.

5. The method of claim 2 and further comprising the steps of:

repeating steps a) and b) to achieve a coating having a desired thickness.

6. The method of claim 1 wherein the powder particles are applied in the first and second coating stages by spraying.

* * * * *